US006295783B1

(12) United States Patent
Davis

(10) Patent No.: US 6,295,783 B1
(45) **Date of Patent: *Oct. 2, 2001**

(54) POST CLADDING ASSEMBLY WITH SHEET RETAINING MEANS

(75) Inventor: Harry H. Davis, Mooresville, NC (US)

(73) Assignee: L.B. Plastics Limited, Darby (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/401,907

(22) Filed: Sep. 23, 1999

Related U.S. Application Data

(63) Continuation of application No. 08/917,409, filed on Aug. 25, 1997, now Pat. No. 5,956,920.

(51) Int. Cl.[7] ..... E04C 3/30

(52) U.S. Cl. ..... 52/736.3; 52/236.1; 52/588.1

(58) Field of Search ..... 52/736.3, 736.4, 52/736.6, 738.1, 732.1, 752.2, 737.2, 730.4, 723.1, 98, 100, 581, 588.1, 730.5, 731.3, DIG. 17, 222

(56) References Cited

U.S. PATENT DOCUMENTS

| | | | |
|---|---|---|---|
| 1,350,027 | | 8/1920 | Lane . |
| 2,897,889 | | 8/1959 | Kessler . |
| 3,199,258 | | 8/1965 | Jentoft et al. . |
| 3,220,469 | | 11/1965 | Oehmig . |
| 3,413,775 | | 12/1968 | Katz . |
| 3,810,337 | | 5/1974 | Pollard . |
| 4,021,987 | | 5/1977 | Schnebel . |
| 4,084,360 | | 4/1978 | Reckson . |
| 4,233,790 | | 11/1980 | Meadows . |
| 4,261,144 | | 4/1981 | Rizzo . |
| 4,410,027 | | 10/1983 | Lucous . |
| 4,467,584 | | 8/1984 | Crites et al. . |
| 4,662,038 | | 5/1987 | Walker . |
| 4,665,670 | | 5/1987 | van den Burg . |
| 4,690,192 | | 9/1987 | Stilling . |
| 4,731,960 | | 3/1988 | Sease . |
| 4,817,655 | * | 4/1989 | Brooks ..... 135/101 |
| 4,899,797 | | 2/1990 | Green . |
| 4,920,714 | * | 5/1990 | Sease ..... 52/222 |
| 5,222,344 | | 6/1993 | Johnson . |
| 5,335,471 | | 8/1994 | Kupiec . |
| 5,647,176 | * | 7/1997 | Milliken ..... 52/63 |
| 5,956,920 | * | 9/1999 | Davis ..... 52/736.3 |

FOREIGN PATENT DOCUMENTS

| | | |
|---|---|---|
| 1298057 | 4/1988 | (CA) . |
| 1165725 | 10/1969 | (GB) . |

OTHER PUBLICATIONS

AFCO Industries, Inc.; AFCO Aluminum Columns; Publication date was prior to the date this application was filed; Entire Brochure.

* cited by examiner

*Primary Examiner*—Beth A. Stephan
(74) *Attorney, Agent, or Firm*—Adams, Schwartz & Evans, P.A.

(57) ABSTRACT

An elongate modular post cladding element is adapted for cooperating with at least one other cladding element to cover a post. The cladding element includes a panel for being applied to the post, and having first and second opposed end edges and first and second opposed, longitudinally-extending side edges. A female fastener extends along the first side edge of the panel. A complementary male fastener extends along the opposed second side edge of the panel. The female fastener has spaced-apart surfaces forming a generally U-shaped groove having a depth at least twice as great as its width. The groove defines a position adjustment zone for receiving a selected portion of a male fastener of an adjacent cladding element to adjustably position the adjacent cladding element on the post. A retaining assembly provided for securing a flexible sheet material to the panel.

18 Claims, 4 Drawing Sheets

POST CLADDING ASSEMBLY WITH SHEET RETAINING MEANS

This application is a continuation-in-part of U.S. Ser. No. 08/917,409 filed on Aug. 25, 1997 now U.S. Pat No. 5,956,920, and entitled "Modular Post Cladding Element, Post Cladding Assembly, and Method of Cladding a Post." The complete disclosure of this prior application is incorporated herein by reference.

TECHNICAL FIELD AND BACKGROUND OF THE INVENTION

The present invention relates to a post cladding assembly including means for retaining a sheet material, such as a wire mesh screen or plastic film, used for enclosing an outdoor deck or porch. The invention is essentially maintenance free, is quickly and easily assembled, and is adjustable to accommodate minor size variations in the post.

In addition to post cladding, the invention provides convenient means for securing a flexible wire mesh screen or plastic film between adjacent, spaced-apart posts of the outdoor deck or porch. The screen and film is readily attached to and removed from the post cladding without the use of special tools or penetrating fasteners.

SUMMARY OF THE INVENTION

Therefore, it is an object of the invention to provide a post cladding assembly which improves the appearance and weather-resistance of wood posts commonly used in outdoor decks and porches.

It is another object of the invention to provide a post cladding assembly which requires relatively little maintenance.

It is another object of the invention to provide a post cladding element which is quickly and easily applied to the post.

It is another object of the invention to provide a post cladding assembly which is adjustable to accommodate slight size variations in the post.

It is another object of the invention to provide a post cladding element which interconnects with like elements to form a cladding assembly.

It is another object of the invention to provide a post cladding assembly which is permanently attached to the post using fasteners which are concealed.

It is another object of the invention to provide a post cladding assembly which includes means for readily attaching a wire mesh screen or plastic film sheet to the post to enclose the area of the outdoor deck or porch.

These and other objects of the present invention are achieved in the preferred embodiments disclosed below by providing an elongate modular post cladding element adapted for cooperating with at least one other cladding element to cover a post. The cladding element includes a panel for being applied to the post, and having first and second opposed end edges and first and second opposed, longitudinally-extending side edges. A female fastener extends along the first side edge of the panel. A complementary male fastener extends along the opposed second side edge of the panel. The female fastener has spaced-apart surfaces forming a generally U-shaped groove. The groove has a depth at least twice as great as its width. The groove defines a position adjustment zone for receiving a selected portion of a male fastener of an adjacent cladding element to adjustably position the adjacent cladding element on the post. Retaining means are provided for securing a flexible sheet material to the panel.

According to another preferred embodiment of the invention, the retaining means includes a longitudinal channel formed with the panel, and an elongated flexible spline adapted for being inserted into the channel to wedge the flexible sheet material between the spline and the panel.

According to yet another preferred embodiment of the invention, spaced-apart, inwardly extending shoulders are integrally formed with the channel and cooperating to secure the spline within the channel.

According to yet another preferred embodiment of the invention, the male and female fasteners extend longitudinally from one end edge of the panel to the other.

According to yet another preferred embodiment of the invention, the male and female fasteners are integrally-formed with the panel.

According to yet another preferred embodiment of the invention, the male fastener includes at least one longitudinally-extending notch therein defining a weakness line for being cut to shorten a lateral dimension of the cladding element.

According to yet another preferred embodiment of the invention, a longitudinally-extending attachment flange is formed adjacent the female fastener for receiving attachment means therethrough to the post for permanently mounting the cladding element to the post.

According to yet another preferred embodiment of the invention, the cladding element is integrally-molded of a plastic material.

According to yet another preferred embodiment of the invention, the retaining means includes a longitudinal channel formed with the panel, and a cap overlying the panel and including a longitudinally-extending, resilient connector strip for being inserted into the channel to hold the cap to the panel, thereby sandwiching the flexible sheet mat erial between the cap and the panel.

According to yet another preferred embodiment of the invention, spaced-apart, inwardly extending shoulders are integrally formed with the channel and cooperate to hold the connector strip within the channel.

According to yet another preferred embodiment of the invention, the connector strip has a generally V-shaped profile, and includes outwardly extending shoulders cooperating with the shoulders of the channel to further secure the cap to the panel.

In another embodiment, the invention is a post cladding assembly including a plurality of post cladding elements for covering a post. Each of the post cladding elements includes a panel for being applied to the post, and having first and second opposed end edges and first and second opposed, longitudinally-extending side edges. A female fastener extends along the first side edge of the panel. A complementary male fastener extends along the opposed second side edge of the panel. The female fastener has spaced-apart surfaces forming a generally U-shaped groove having a depth at least twice as great as its width. The groove defines a position adjustment zone for receiving a selected portion of a male fastener of an adjacent cladding element to adjustably position the adjacent cladding element on the post. Retaining means are provided for securing a flexible sheet material to the panel.

According to another preferred embodiment of the invention, first and second longitudinally extending ridges are integrally formed with the panel of the post cladding element, and are spaced apart for residing adjacent opposite longitudinal side edges of the cap upon attachment of the cap to the panel.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
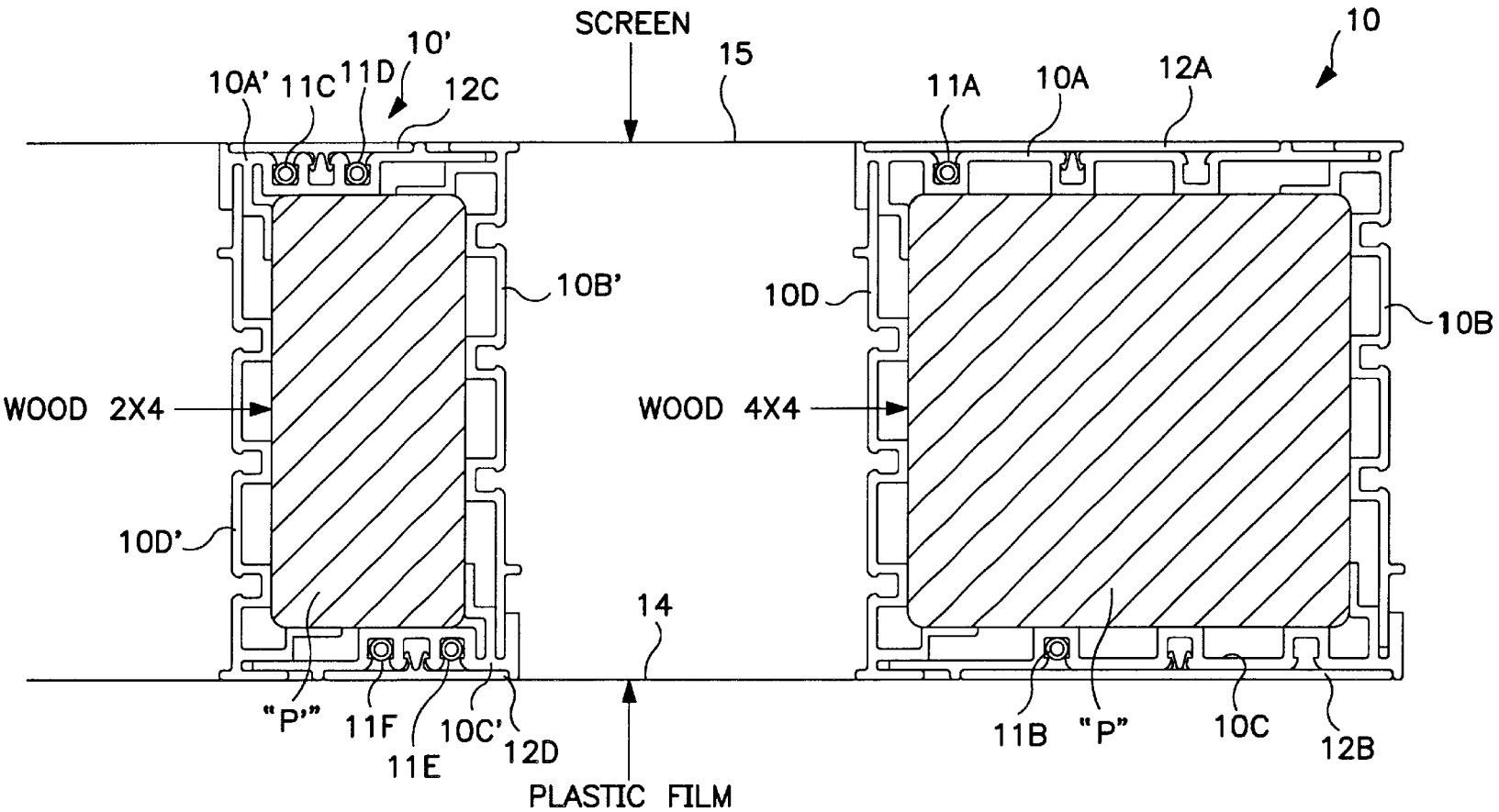
FIG. 1 is a plan view of two post cladding assemblies formed according to a preferred embodiment of the present invention, and applied to the sides of respective posts with a wire mesh screen and plastic film extending between the posts.

Referring now specifically to the drawings, post cladding assemblies according to the present invention are illustrated in FIG. 1 and shown generally at reference numerals 10 and 10', respectively. The cladding assemblies 10 and 10' are particularly applicable for cladding standard 4×4 and 2×4 wood posts commonly used in outdoor decks and porches. For square posts "P", the cladding assembly 10 is formed of four identical, elongate, modular post cladding elements 10A, 10B, 10C, and 10D adapted for covering respective sides of the post. For 2×4 posts "P'", the cladding assembly 10' is formed of cladding elements 10A' and 10B' identical to those applied to the square post "P" and smaller cladding elements 10C' and 10D' for covering the narrower sides of the post "P'". The cladding assemblies 10 and 10' preferably extend the entire length of the posts and function to provide an aesthetic, generally maintenance-free exterior covering.

The cladding elements 10A–10D and 10A'–10D' cooperate with elongated flexible splines 11A, 11B, 11C, 11D, 11E, and 11F and caps 12A, 12B, 12C, and 12D, as described further below, to secure a plastic film 14 and/or wire screen 15 to the posts to enclose the outdoor deck or porch. The post cladding elements 10A–10D and 10A'–10D' and caps 12A–12D are preferably individually formed of extruded, U.V. stabilized, high-impact rigid PVC. The splines 11A–11F are preferably formed of a resilient plastic or rubber material.

Description of Post Cladding Element 20

Figure 2:
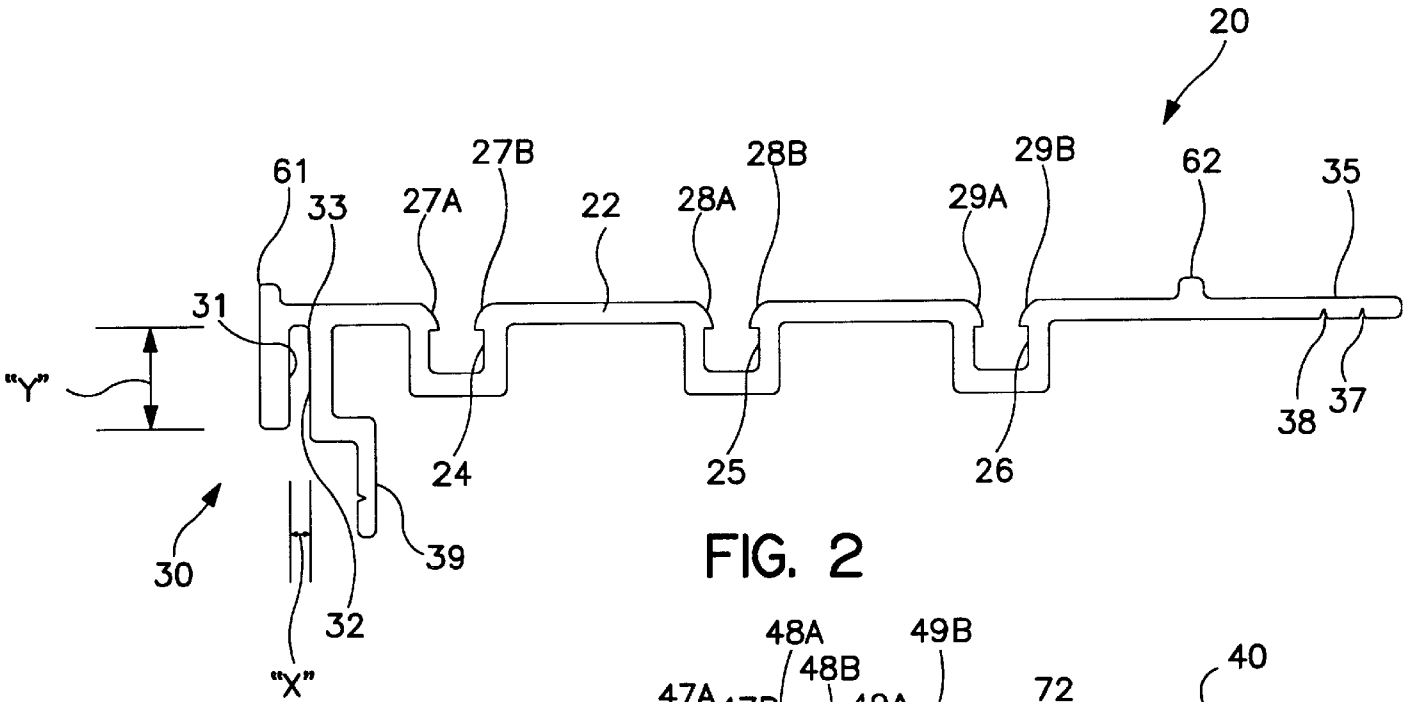
FIG. 2 is an end view of a post cladding element according to one preferred embodiment of the invention.

A single post cladding element 20 according to the invention is shown in FIG. 2. The cladding element 20 includes a panel 22 having opposing end edges and opposing longitudinal side edges. The panel 22 defines spaced-apart locking channels 24, 25, and 26 extending parallel to the side edges and longitudinally from one end edge to the other. The locking channels 24, 25, and 26 include respective pairs of spaced shoulders 27A, 27B, 28A, 28B, and 29A, 29B. A female fastener 30 is integrally-formed along the first side edge of the panel 22, and includes spaced walls 31 and 32 forming a groove 33 oriented generally perpendicular to the exterior plane of the panel 22. A complementary male fastener 35 is integrally-formed along the opposed second side edge of the panel 22, and cooperates with a female fastener of an adjacent cladding element to interlock the two cladding elements together on adjacent sides of the post. Preferably, the female fastener 30 and male fastener 35 extend the entire length of the panel 22, and include respective engaging serrations (not shown).

The groove 33 of the female fastener 30 has a generally U-shaped profile adapted for receiving the male fastener of an adjacent cladding element. The depth "y" of the groove 33 is preferably about 3–4 times greater than its width "x", such that the amount of male fastener received into the groove 33 can be adjusted within an adjustment zone defined by the distance "y" for increasing or decreasing the lateral coverage of the adjacent cladding element on the post. For added size adjustment, the male fastener 35 includes spaced notches 37 and 38 which define respective 10o weakness lines for being cut to shorten the lateral dimension of the cladding element 20. The notches 37, 38 preferably extend the entire length of the panel 22 from one end edge to the other.

In addition, an attachment flange 39 is formed with the female fastener 30, and extends generally perpendicular to the plane of the panel 22 for receiving nails or other suitable attachment means, such as tacks, staples, or the like. The nails pass through the attachment flange 39 and into the wood post to permanently attach the cladding element to the post.

Description of Post Cladding Element 40

Figure 3:
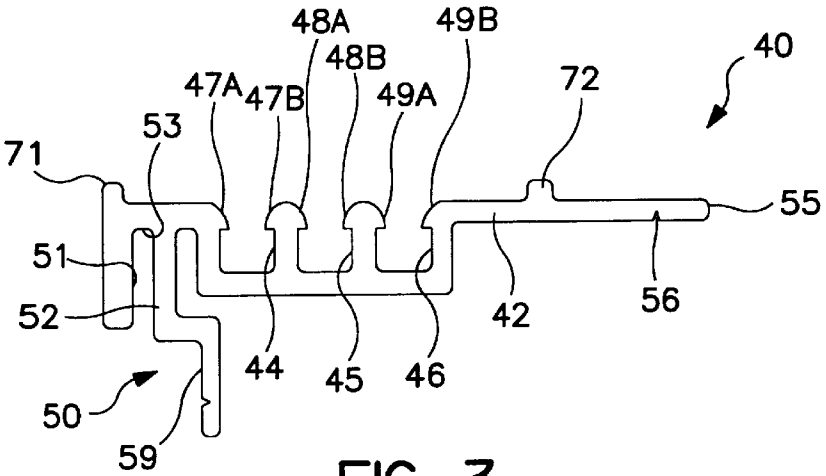
FIG. 3 is an end view of a post cladding element according to another preferred embodiment of the invention.
Figure 5:
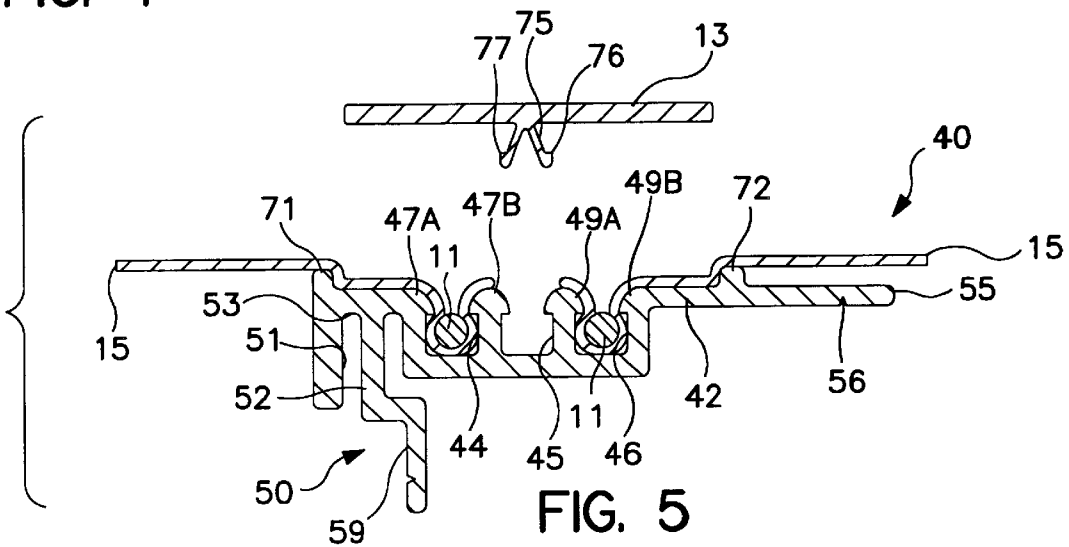
FIG. 5 is a cross-sectional view of the post cladding assembly including a post cladding element shown in FIG. 3, and showing the screen retained in the locking channels and the cap removed.
Figure 6:
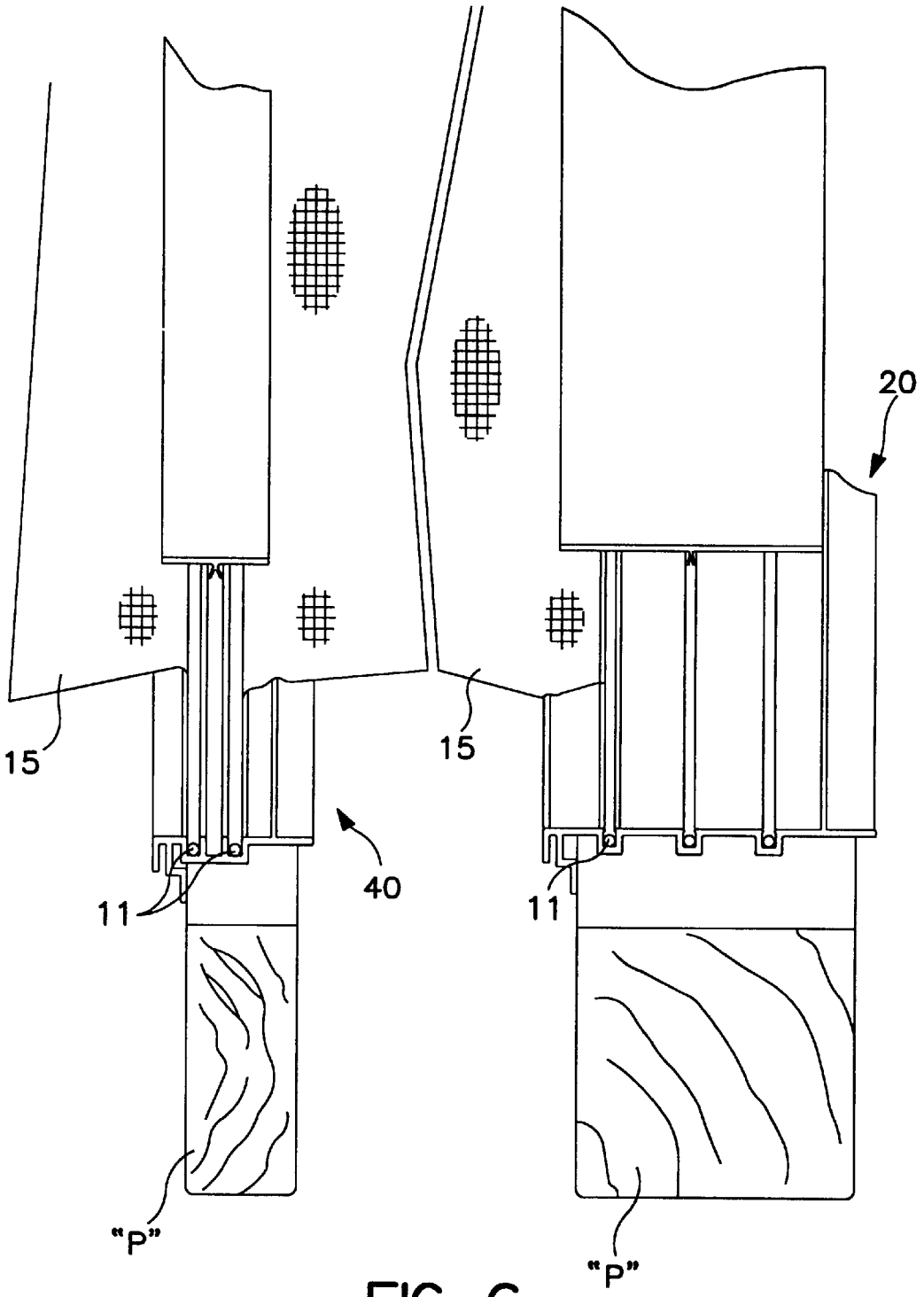
FIG. 6 is fragmentary, perspective view of two post cladding elements applied to respective sides of adjacent posts with the wire mesh screen secured within the locking channels and extending between the posts.

A post cladding element 40 adapted for covering the narrower sides of the 2×4 wood post "P'" is best shown in FIGS. 3, 5, and 6. The cladding element includes a panel 42 having opposing end edges and opposing longitudinal side edges. The panel 42 defines spaced-apart locking channels 44, 45, and 46 extending parallel to the side edges and longitudinally from one end edge to the other. The locking channels 44, 45, and 46 include respective pairs of spaced shoulders 47A, 47B, 48A, 48B, and 49A, 49B. A female fastener 50, identical to that previously described, is integrally-formed along the first side edge of the panel 42, and includes spaced walls 51 and 52 forming a groove 53 oriented generally perpendicular to the exterior plane of the panel 42. A complementary male fastener 55 is integrally-formed along the opposed second side edge of the panel 42, and cooperates with a female fastener of an adjacent cladding element to interlock the two cladding elements together on adjacent sides of the post. The male fastener 55 includes a notch 56 which defines a weakness line for being cut to shorten the lateral dimension of the cladding element 40. The notch 56 preferably extends the entire length of the panel 42 from one end edge to the other. An attachment flange 59 is formed with the female fastener 50, and extends generally perpendicular to the plane of the panel 42 for receiving nails or other suitable attachment means, such as tacks, staples, or the like. The nails (not shown) pass through the attachment flange 59 and into the wood post to permanently attach the cladding element 40 to the post.

Attachment of the Wire Screen and Plastic Film to the Posts

After assembly of the cladding elements 10A–10D and 10A'–10D' on the posts "P" and "P'", as shown in FIG. 1, the plastic film 14 and/or wire mesh screen 15 is attached to enclose the outdoor deck or porch area. While the following description refers only to the screen 15, it is understood that the means for attaching the plastic film 14 is identical.

Figure 4:
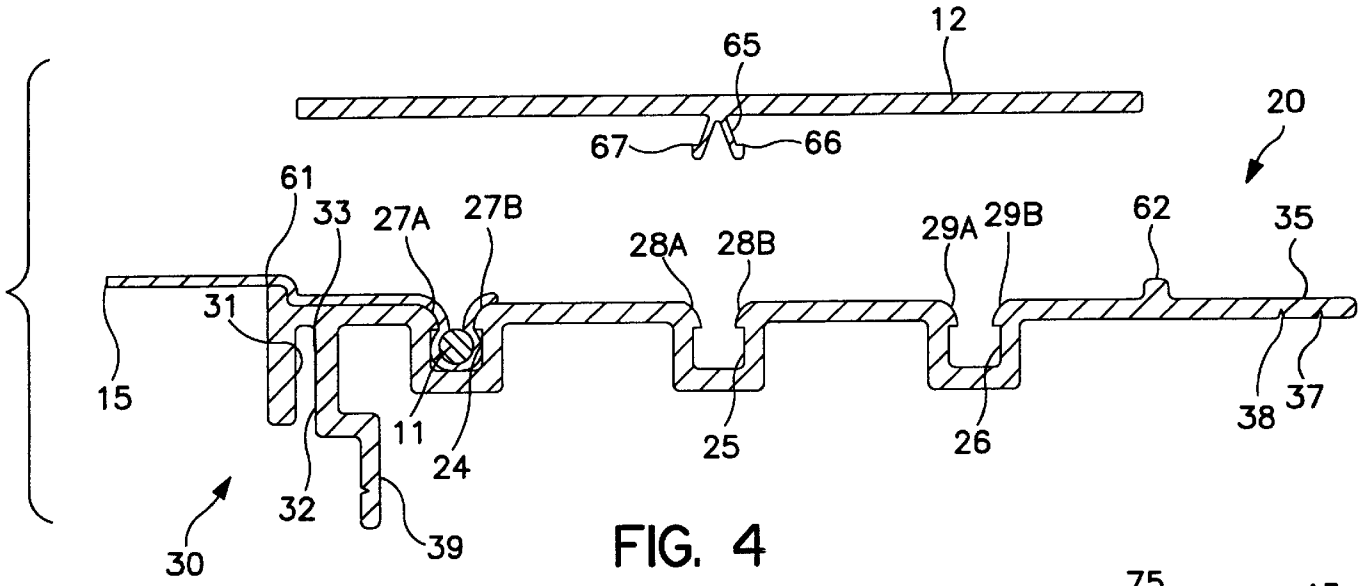
FIG. 4 is a cross-sectional view of the post cladding assembly including a post cladding element shown in FIG. 2, and showing the screen retained in the locking channel and the cap removed.

Referring now to FIGS. 4 and 6, with the cap 12 removed, the marginal edge portion of the screen 15 is first placed against the cladding element 20 of the post "P" to cover the locking channel 24. The resilient spline 11 is then forced into the channel 24 between the locking shoulders 27A and 27B to tightly wedge the screen 15 between the spline 11 and the cladding element 20. The diameter of the spline 11 is sufficiently large relative to the channel 24 to secure the screen 15 to the cladding element 20. The locking shoulders 27A and 27B cooperate to hold the spline 11 in the channel 24, and to prevent the spline 11 from being inadvertently dislodged. If necessary, a hammer or other suitable tool may be used to force the spline 11A into the channel 24.

After attaching the screen 15 the cap 12 is placed between laterally-spaced ridges 61 and 62 formed with the outside surface of the panel 22. The cap 12 includes a generally v-shaped, longitudinally extending, resilient connector strip 65 integrally formed on its inside surface for being inserted into the locking channel 25 of the cladding element 20. The connector strip 65 preferably includes locking shoulders 66 and 67 which cooperate with the shoulders 28A and 28B to secure the cap 12 to the cladding element 20. The cap 12 provides an aesthetic covering for concealing the channels 24, 25, and 26, and cooperates with the ridges 61 and 62 to further secure the screen 15 to the cladding element 20.

Attachment of the screen 15 to cladding element 40 is best shown in FIGS. 5 and 6. As previously described, with the cap 13 removed, the marginal edge portion of each screen 15 is first placed against the cladding element 40 of the post "P'" to cover the locking channels 44 and 46, respectively. Resilient splines 11 are then forced into the channels 44 and 46 between the locking shoulders 47A, 47B and 49A, 49B to tightly wedge the screens 15 between the spline 11 and the cladding element 40. The locking shoulders 47A, 47B and 49A, 49B cooperate to hold the splines 11 in the channels 44 and 46.

After attaching the screen 15, the cap 13 is placed between spaced longitudinal ridges 7 1 and 72 formed with the outside surface of the panel 42. The cap 13 includes a generally v-shaped, longitudinally extending, resilient connector strip 75 integrally formed on its inside surface for being inserted into the locking channel 45 of the cladding element 40. The connector strip 75 preferably includes locking shoulders 76 and 77 which cooperate with the shoulders 48A and 48B to secure the cap 13 to the cladding element 40. The cap 13 provides an aesthetic covering for concealing the channels 44, 45, and 46, and cooperates with the ridges 71 and 72 to further secure the screen 15 to the cladding element 40.

Post cladding assemblies 10 and 10' are described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. An elongate modular post cladding element adapted for cooperating with at least one other cladding element to cover a post, said cladding element comprising:

(a) a panel for being applied to the post, and having first and second opposed end edges and first and second opposed, longitudinally-extending side edges;

(b) a female fastener extending along the first side edge of said panel;

(c) a complementary male fastener extending along the opposed second side edge of said panel;

(d) said female fastener comprising spaced-apart surfaces forming a generally U-shaped groove, said groove having a depth thereof at least twice as great as a width thereof to define a position adjustment zone for receiving therein a selected portion of a male fastener of an adjacent cladding element to adjustably position the adjacent cladding element on the post; and (e) retaining means for securing a flexible sheet material to said panel.

2. A post cladding clement according to claim 1, wherein said retaining means comprises a longitudinal channel formed with said panel, and an elongated flexible spline adapted for being inserted into said channel to wedge the flexible sheet material between said spline and said panel.

3. A post cladding element according to claim 2, and comprising spaced-apart, inwardly extending shoulders integrally formed with said channel and cooperating to secure said spline within said channel.

4. A post cladding element according to claim 1, wherein said male and female fasteners extend longitudinally from one end edge of the panel to the other.

5. A post cladding element according to claim 1, wherein said male and female fasteners are integrally-formed with said panel.

6. A post cladding element according to claim 1, wherein said male fastener includes at least one longitudinally-extending notch therein defining a weakness line for being cut to shorten a lateral dimension of the cladding element.

7. A post cladding element according to claim 1, and including a longitudinally-extending attachment flange formed adjacent the female fastener for receiving attachment means therethrough to the post for permanently mounting the cladding element to the post.

8. A post cladding element according to claim 1, wherein said cladding element is integrally-molded of a plastic material.

9. A post cladding element according to claim 1, wherein said retaining means comprises a longitudinal channel formed with said panel, and a cap overlying said panel and including a longitudinally-extending, resilient connector strip for being inserted into said channel to hold said cap to said panel, thereby sandwiching the flexible sheet material between said cap and said panel.

10. A post cladding element according to claim 9, and comprising spaced-apart, inwardly extending shoulders integrally formed with said channel and cooperating to hold said connector strip within said channel.

11. A post cladding element according to claim 10, wherein said connector strip has a generally V-shaped profile, and includes outwardly extending shoulders cooperating with the shoulders of said channel to further secure said cap to said panel.

12. A post cladding assembly comprising a plurality of post cladding elements for covering a post, each of said post cladding elements comprising:

(a) a panel for being applied to the post, and having first and second opposed end edges and first and second opposed, longitudinally-extending side edges;

(b) a female fastener extending along the first side edge of said panel;

(c) a complementary male fastener extending along the opposed second side edge of said panel;

(d) said female fastener comprising spaced-apart surfaces forming a generally U-shaped groove, said groove having a depth thereof at least twice as great as a width thereof to define a position adjustment zone for receiving therein a selected portion of a male fastener of an adjacent cladding element to adjustably position the adjacent cladding element on the post; and (e) retaining means for securing a flexible sheet material to said panel.

13. A post cladding assembly according to claim 12, wherein said retaining means of said post cladding element comprises a longitudinal channel formed with said panel, and an elongated flexible spline adapted for being inserted into said channel to wedge the flexible sheet material between said spline and said panel.

14. A post cladding assembly according to claim 13, and comprising spaced-apart, inwardly extending shoulders integrally formed with said channel of said post cladding element and cooperating to secure said spline within said channel.

15. A post cladding assembly according to claim 12, wherein said retaining means comprises a longitudinal channel formed with said panel of said post cladding element, and a cap overlying said panel and including a longitudinally-extending, resilient connector strip for being inserted into said channel to hold said cap to said panel, thereby sandwiching the flexible sheet material between said cap and said panel.

16. A post cladding assembly according to claim 15, and comprising spaced-apart, inwardly extending shoulders integrally formed with said channel of said post cladding element and cooperating to hold said connector strip within said channel.

17. A post cladding assembly according to claim 16, wherein said connector strip has a generally V-shaped profile, and includes outwardly extending shoulders cooperating with the shoulders of said channel to further secure said cap to said panel.

18. A post cladding assembly according to claim 15, and comprising first and second longitudinally-extending ridges integrally formed with said panel of said post cladding element, and spaced-apart for residing adjacent opposite longitudinal side edges of said cap upon attachment of said cap to said panel.

* * * * *